US009423077B2

(12) United States Patent
Adelman

(10) Patent No.: US 9,423,077 B2
(45) **Date of Patent: *Aug. 23, 2016**

(54) CYLINDER SAFETY SYSTEM

(71) Applicant: Air Liquide Advanced Technologies U.S. LLC, Houston, TX (US)

(72) Inventor: Ryan B. Adelman, Wilmington, DE (US)

(73) Assignee: Air Liquide Advanced Technologies U.S. LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/043,998

(22) Filed: Oct. 2, 2013

(65) Prior Publication Data

US 2015/0091317 A1 Apr. 2, 2015

(51) Int. Cl.
*A45F 5/00* (2006.01)
*F17C 13/08* (2006.01)

(52) U.S. Cl.
CPC ..... *F17C 13/084* (2013.01); *F17C 2201/0109* (2013.01); *F17C 2201/0119* (2013.01); *F17C 2201/032* (2013.01); *F17C 2201/037* (2013.01); *F17C 2201/056* (2013.01); *F17C 2201/058* (2013.01); *F17C 2203/0646* (2013.01); *F17C 2205/018* (2013.01); *F17C 2205/0115* (2013.01); *F17C 2205/0126* (2013.01); *F17C 2205/0165* (2013.01); *F17C 2223/0123* (2013.01); *F17C 2223/036* (2013.01); *F17C 2270/02* (2013.01); *F17C 2270/07* (2013.01)

(58) Field of Classification Search
CPC . A45F 5/10; A45F 5/1046; A45F 2005/1073; A45F 5/102; A45F 2005/1013; A45F 3/14; F16M 13/06; A45C 13/26; B65D 23/104; B65D 23/106; B65D 63/18; A47J 45/077
USPC ..... 294/141, 142, 27.1, 31.2, 149, 153, 294/157, 167, 169; 215/390, 396, 395
See application file for complete search history.

(56) References Cited

U.S. PATENT DOCUMENTS

| | | | | |
|---|---|---|---|---|
| 1,757,471 | A * | 5/1930 | Platt | 248/96 |
| 1,965,726 | A * | 7/1934 | Smith, Jr. | 294/169 |
| 2,844,346 | A * | 7/1958 | Six | 248/141 |
| 4,336,899 | A * | 6/1982 | Price, II | 224/609 |
| D280,953 | S * | 10/1985 | Paul | D3/316 |
| D281,832 | S * | 12/1985 | Trull | D3/316 |
| 4,556,245 | A * | 12/1985 | Gruenwald | 294/31.2 |
| 4,979,659 | A * | 12/1990 | Boyd | 224/603 |
| 7,976,088 | B1 * | 7/2011 | Diciolla | 294/154 |
| 2006/0255006 | A1 * | 11/2006 | Wagenknecht et al. | 215/396 |
| 2009/0014454 | A1 * | 1/2009 | Nelson | 220/758 |
| 2009/0065469 | A1 * | 3/2009 | McClellan et al. | 215/390 |

* cited by examiner

*Primary Examiner* — Gabriela Puig
(74) *Attorney, Agent, or Firm* — Elwood L. Haynes

(57) ABSTRACT

A cylinder caddy, adapted to a bottle with a neck, a bottom, and a center of gravity is provided. The caddy has a strap configured to affix circumferentially to the cylinder at a location higher than the center of gravity, and at least one axial strap configured to connect the strap. The caddy includes a handle with a first end pivotally attached to the upper strap, and a second end configured to detachably connect to the neck. In a first position, the handle is pivoted to allow the second end to be attached to the neck, thereby requiring the removal of a regulator, protecting the neck from dust and other particulates and allowing a user to safely carry the cylinder. In a second position, the handle is pivoted to allow the second end form a strut, thereby providing the user a more stable operating position.

3 Claims, 7 Drawing Sheets

CYLINDER SAFETY SYSTEM

BACKGROUND

Portable cylinders are commonly used to supply a variety of pure and mixed gas standards for use in industrial, medical, commercial, or residential applications. The portable cylinders may contain reactive, non-reactive, as well as flammable gas mixtures in pure form or mixed concentrations. These cylinders are used in many applications including but not limited to welding and cutting, the calibration of medical devices, as well as fixed and portable confined space and breath alcohol testing monitors.

Most portable cylinders have a relatively high ratio of length (or height) to diameter. They usually have a flat bottom and a rounded top. As these cylinders typically have service pressures of 155 psi to over 2200 psi, they are constructed with very thick walls. They are often made of steel or aluminum. These cylinders tend to be unstable whether they are standing vertically or lying horizontally. When standing vertically, especially if they have a relatively heavy regulator attached, they are prone to tipping over. When lying horizontally, they tend to roll, especially during transport.

The consequences of a pressurized cylinder accidentally discharging its contents due to tipping over or rolling can be disastrous. The accidental release of the potential energy within the cylinder can cause immediate danger to both life and property. Although the cylinders may look small, the contents can be under significant pressure, and when released uncontrollably they can displace air, creating an asphyxiation hazard. In some cases the cylinders may contain flammable or even poisonous gas.

Hence, a need exists in the industry, for a simple, safe, and effective means to transport and provide a stable working platform for portable, high pressure cylinders.

SUMMARY

A cylinder caddy, adapted to a bottle with a neck, a bottom, and a center of gravity is provided. The caddy has a strap configured to affix circumferentially to the cylinder at a location higher than the center of gravity, and at least one axial strap configured to connect the strap. The caddy includes a handle with a first end pivotally attached to the upper strap, and a second end configured to detachably connect to the neck. In a first position, the handle is pivoted to allow the second end to be attached to the neck, thereby requiring the removal of a regulator, protecting the neck from dust and other particulates and allowing a user to safely carry the cylinder. In a second position, the handle is pivoted to allow the second end form a strut, thereby providing the user a more stable operating position.

DESCRIPTION OF PREFERRED EMBODIMENTS

Figure 1:
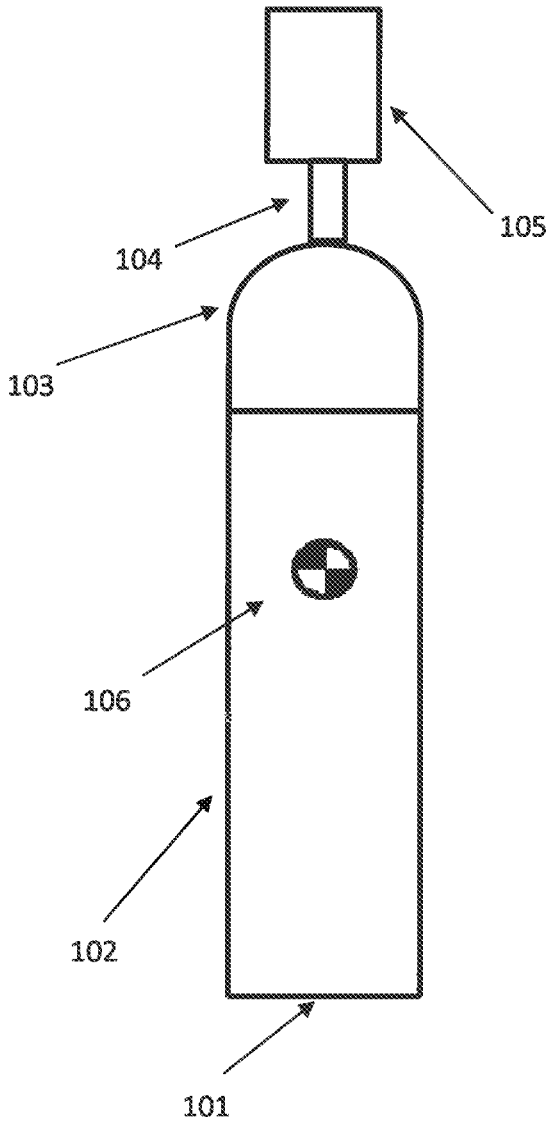
FIG. 1 illustrates a typical portable cylinder, in accordance with existing art.

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As illustrated in FIG. 1, a typical portable cylinder will have a bottom 101, sides 102, a rounded top 103, and a neck 104. A flow or pressure regulator 105 will be attached to neck 104 during normal operation. Regardless of the material of construction, but especially if the cylinder is made of aluminum, the center of gravity 106 will be relatively high in the cylinder when regulator 105 is attached. This will tend to make the cylinder assembly top heavy and prone to tipping during use.

Therefore, during the usage of the cylinder assembly, safety and stability are concerns. If the cylinder is simply laid on its side, rolling instability is now a potential problem. There is also a concern about contamination, should the cylinder assembly simply be laid down on its side. The regulator and any attached hoses might inadvertently come into contact with surfaces that could taint the gas. So, laying the cylinder on the side is not an ideal solution due to this inherent instability.

Figure 2B:
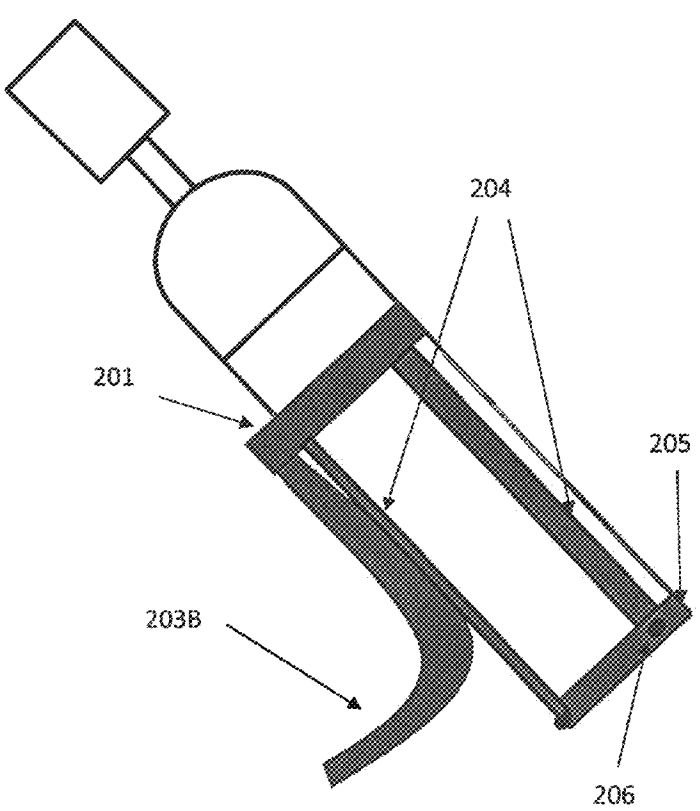
FIG. 2B illustrates another embodiment of the present invention.
Figure 2A:
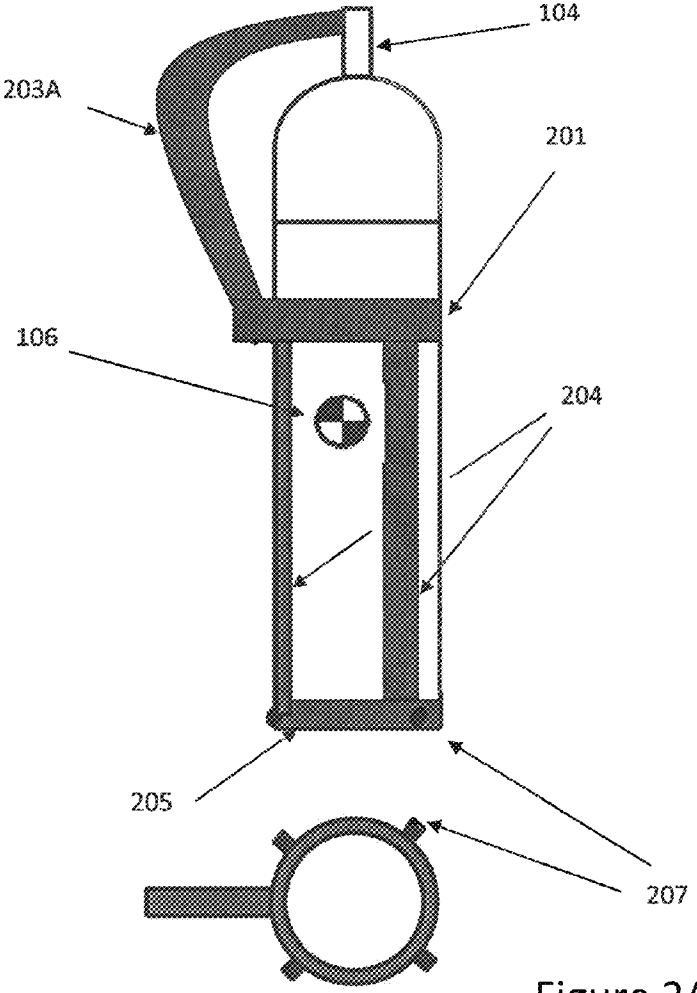
FIG. 2A illustrates another embodiment of the present invention.

Turning to FIGS. 2A and 2B, a cylinder caddy is provided. The caddy includes a strap 201 that may be configured to affix circumferentially to the cylinder at a location which may be higher than the center of gravity 106 (shown). Strap 201 may be located at a position that is approximately equal to the center of gravity 105 (not shown). Strap 201 may be located at a position that is lower than the center of gravity 106 (not shown). In one embodiment, strap 201 is adjustable, and may have a buckle, hook and loop, clip, or any other means known in the art to secure it to the cylinder. In another embodiment, strap 201 may be made of an elastic polymer. At least one axial strap 204 may be attached to strap 201.

A handle 203A/203B is pivotally attached to strap 201. In a first position, handle 203A is pivoted to allow the second end to attach to the neck or valve 104 of the cylinder. In this first position, it will be required that the regulator 105 be removed from the cylinder, thereby encouraging the industry recognized best practice of removing the flow regulator 105 when the cylinder is not in use, or in transit. If flow regulator 105 is left attached to the cylinder when not in use, the regulator may be damaged, or the entire contents of the cylinder my vent if there is a regulator leak.

In a second position, handle 203B may be pivoted to allow the second end to form a brace, strut, or stand, thereby providing the user a more stable mode of operation (such as calibration).

As indicated in FIGS. 2A and 2B, in a second position, handle 203B may be pivoted to allow handle 203 to attach to strap 204 or the cylinder body itself. As indicated in FIGS. 2A and 2B, with handle 203B in the second position, it may still form a brace or may simply provide a means for keeping the cylinder from rolling while in a horizontal position.

Thus the handle mount serves multiple functions. In the first position, the second end fits snugly inside or around the cylinder valve or neck 104. This provides a secure connection between handle 203A and the cylinder. This also helps to protect the valve 104 from damage or contamination during storage.

A bottom cup 205 may be configured to affix circumferentially to the cylinder at the bottom. At least one axial strap 204 may be connected to the strap 201 and the bottom cup 205. Handle 203A/203B may be attached to strap 201 or axial strap 204. Bottom cup 205 may be constructed of a soft polymer, thus adding to the stability of the cylinder. Bottom cup 205 may be constructed of a hard, inelastic material, which may enhance cylinder stability by adding weight to the bottom of the cylinder. Bottom cup 205 may include additional stabilizing devices such as suction cups, friction patches, etc. Stabilizing buttons or nubs 207 may be located along the perimeter of bottom cup 205, thus enhancing stability while the cylinder is in the second position, standing, or laying on its side.

The cylinder may be rotated in strap 201 and/or bottom cup 205 as necessary to position the cylinder as needed during use.

Figure 3B:
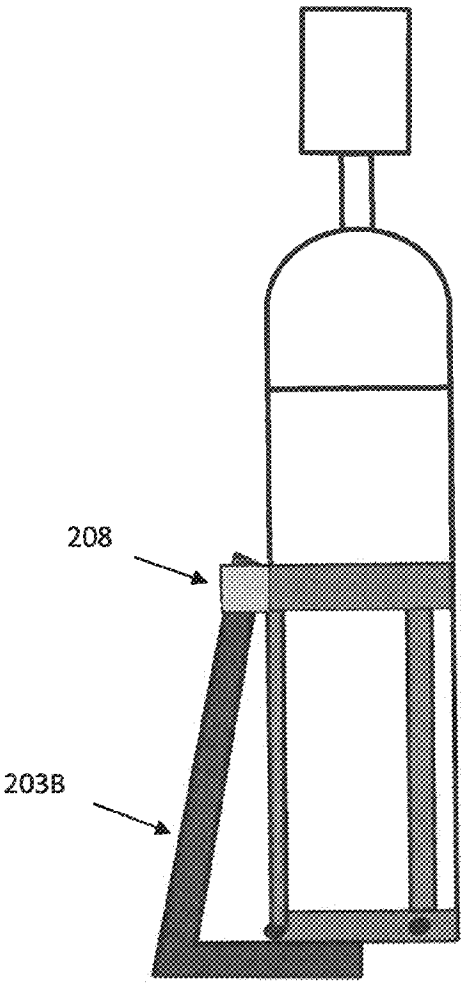
FIG. 3B illustrates another embodiment of the present invention.
Figure 3A:
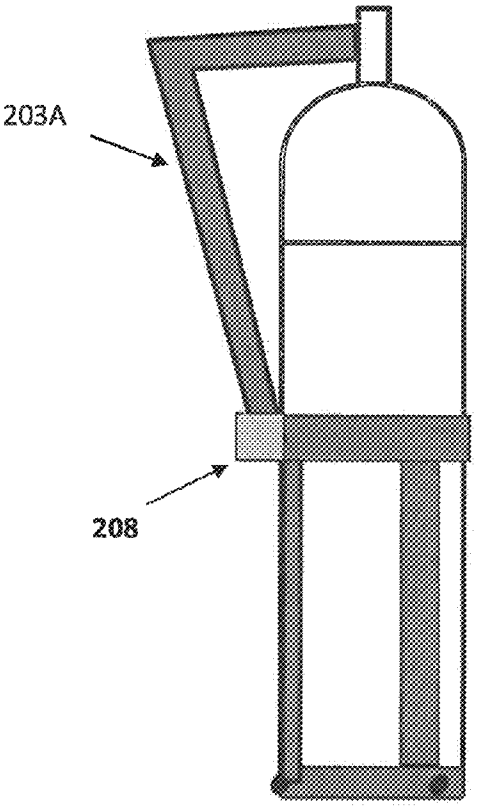
FIG. 3A illustrates another embodiment of the present invention.

As indicated in FIGS. 3A, 3B, 4A, 4B, and 4C, handle 203A/203B may be designed to pivot in two frames of reference. In one frame of reference, as indicated in FIGS. 3A and 3B, the handle pivots in a radial direction, forming an arc along the length of the cylinder.

Figures 4A, 4B, 4C:
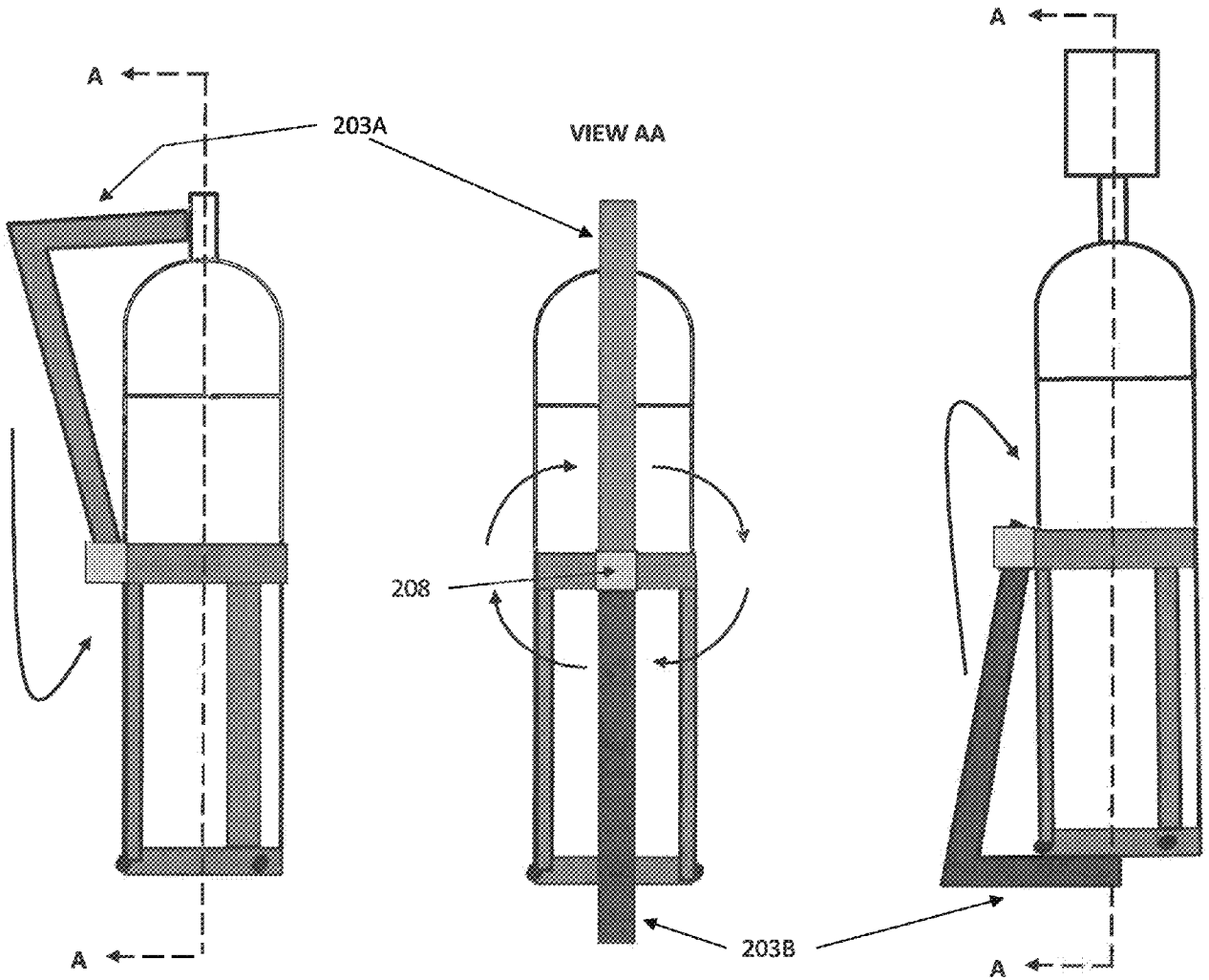
FIG. 4A illustrates another embodiment of the present invention.
FIG. 4B illustrates another embodiment of the present invention.
FIG. 4C illustrates another embodiment of the present invention.
Figures 5A, 5B:
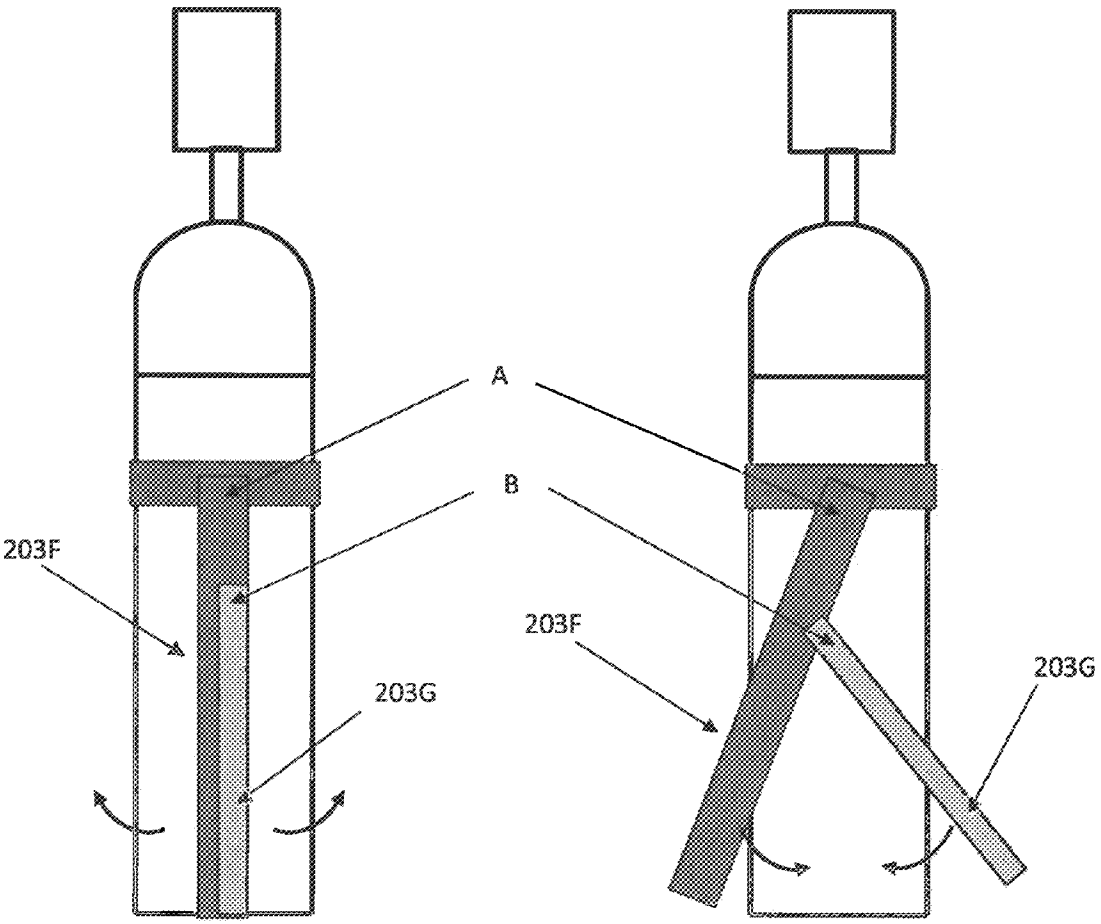
FIG. 5A illustrates another embodiment of the present invention.
FIG. 5B illustrates another embodiment of the present invention.
Figure 6B:
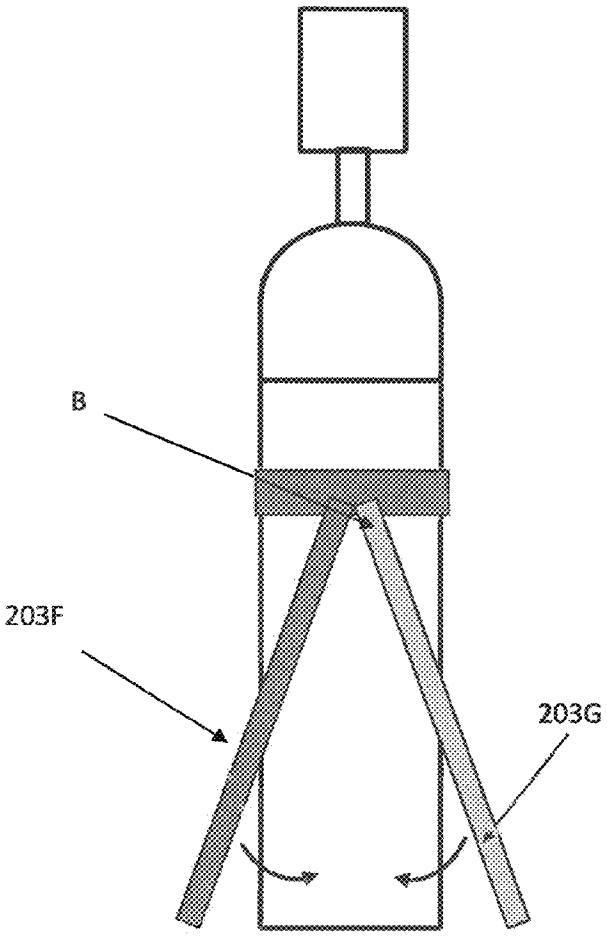
FIG. 6B illustrates another embodiment of the present invention.
Figure 6A:
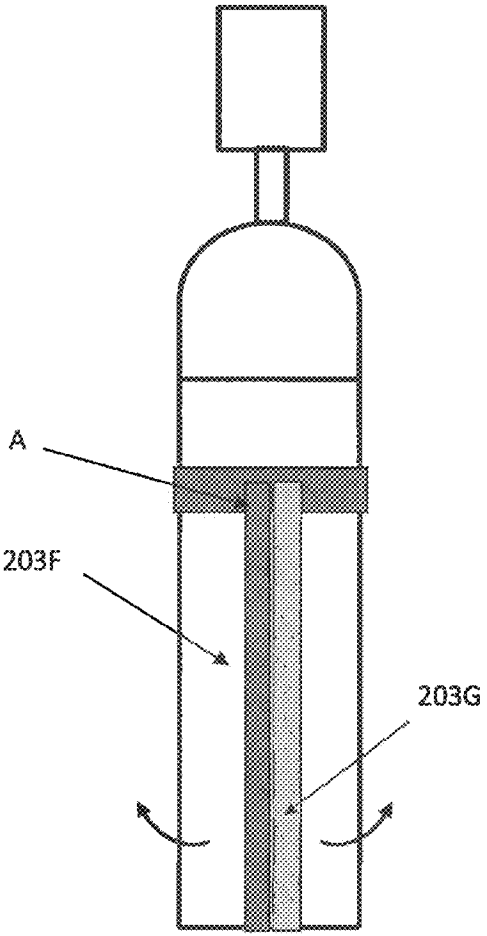
FIG. 6A illustrates another embodiment of the present invention.

In another frame of reference, as indicated in FIGS. 4A, 4B, and 4C, the handle rotates in a direction normal to the length of the cylinder. This allows the angle of the handle to attach to the neck of the cylinder (203A) in the first position, and attach to the bottom of the cylinder (203B) in the second position. Attachment 208 may be designed to allow handle 203A to attach to the cylinder neck or valve in a first position. Then attachment 208 may pivot as in the above figures, but also pivot as indicated in View AA, thereby allowing the handle to attach to the bottom of the cylinder in a second position 203B.

As indicated in FIGS. 5A, 5B, 6A, and 6B, handle 203F/203G may have alternative configurations such as a pivoting scissor orientation, wherein in a first position (FIG. 5*a*) the "blades" 203F and 203G are closed and form a carrying handle. Then in a second position (FIG. 5*b*) the "blades" 203F and 203G are open and form a support means for the cylinder. The handle may open at a first pivot point A and simultaneously open in a complementary way at a second pivot point B, thereby creating a stable orientation.

Figure 7B:
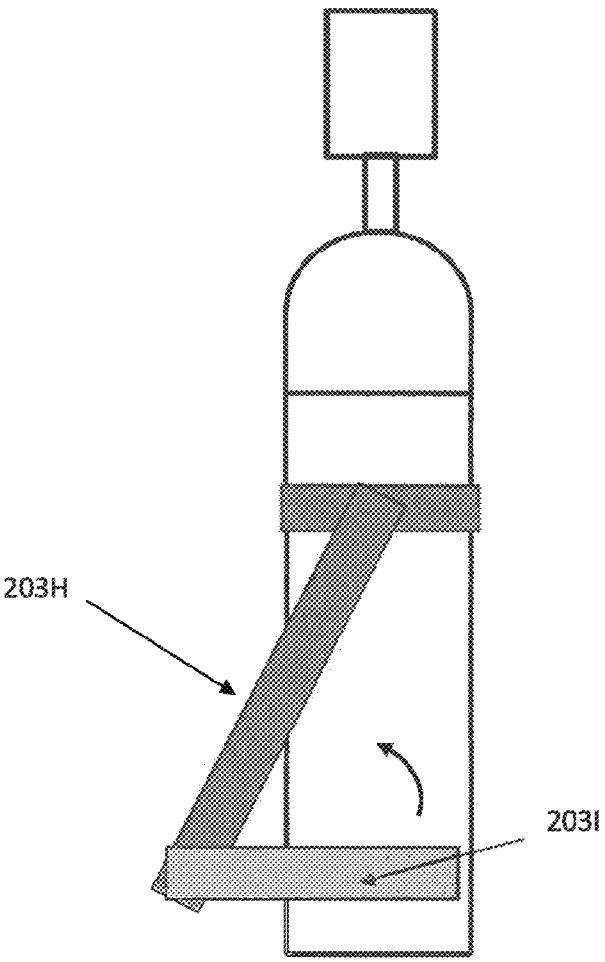
FIG. 7B illustrates another embodiment of the present invention.
Figure 7A:
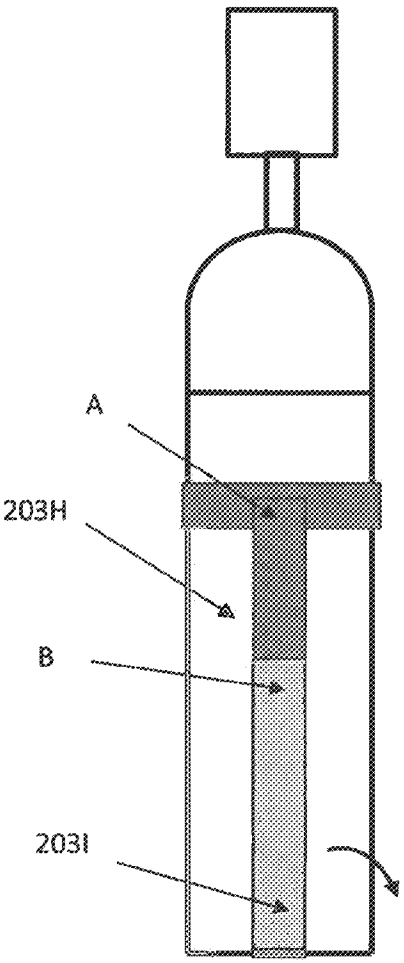
FIG. 7A illustrates another embodiment of the present invention.

Likewise, a pivoting orientation such as indicated in FIGS. 7A and 7B may be utilized. In a first position (FIG. 7*a*) arms 203H and 203I form a handle. In a second position (FIG. 7*b*) arms 203H and 203I open to form a support means. Other configurations known to the art may also be employed.

What is claimed is:

1. A cylinder caddy, adapted to a bottle with a neck, a bottom, and a center of gravity, comprising:

a strap configured to affix circumferentially to the cylinder, a handle with a first end pivotally attached to the strap, and a second end configured to detachably connect to the neck, wherein, in a first position, the handle is pivoted to allow the second end to be attached to the neck, thereby requiring the removal of a regulator, in a second position, the handle is pivoted to allow the attachment of the regulator, thereby forming a stable strut to support the cylinder.

2. The cylinder caddy of claim 1, wherein the handle is configured to rotate in a direction normal to the cylinder.

3. The cylinder caddy of claim 1, wherein the handle is configured to pivot at a first pivot point and a second pivot point, thereby forming the stable strut.

* * * * *